United States Patent [19]

Keritsis

[11] 4,301,817

[45] Nov. 24, 1981

[54] METHOD FOR SELECTIVE DENITRATION OF TOBACCO

[75] Inventor: Gus D. Keritsis, Richmond, Va.

[73] Assignee: Philip Morris Incorporated, New York, N.Y.

[21] Appl. No.: 127,386

[22] Filed: Mar. 5, 1980

[51] Int. Cl.[3] ..... A24B 15/24

[52] U.S. Cl. ..... 131/297

[58] Field of Search ..... 131/143, 141, 140 C

[56] References Cited

U.S. PATENT DOCUMENTS

| | | | |
|---|---|---|---|
| 3,139,435 | 6/1964 | Staley et al. | 131/143 |
| 3,145,717 | 8/1964 | Osborne et al. | 131/143 |
| 3,369,906 | 2/1968 | Chen | 131/143 |

FOREIGN PATENT DOCUMENTS

| | | | |
|---|---|---|---|
| 2816427 | 9/1979 | Fed. Rep. of Germany | 131/143 |

*Primary Examiner*—V. Millin

*Attorney, Agent, or Firm*—Watson, Leavenworth, Kelton & Taggart

[57] ABSTRACT

A process for treating tobacco to reduce the delivery of various gas phase components, during combustion of tobacco products is disclosed. The process comprises contacting tobacco material with an aqueous solution to form a tobacco extract. After separating the extract from the fibrous tobacco portion, the extract is treated by an ionic extraction means such that nitrate ions are extracted while the potassium ion content of the extract is left substantially intact. The treated extract may then be recombined with the fibrous tobacco products. Such products exhibit reduced delivery of nitrogen oxides, HCN and CO during combustion.

17 Claims, 1 Drawing Figure

METHOD FOR SELECTIVE DENITRATION OF TOBACCO

BACKGROUND OF THE INVENTION

1. Field of the Invention

This invention relates to a method for maximizing reduction of delivery of nitrogen oxides, HCN and CO in tobacco smoke. In accordance with the invention, tobacco is denitrated in a manner which selectively removes nitrate ions from tobacco extract without substantially reducing the potassium ion level. By leaving the potassium ion level substantially intact, a greater reduction in delivery of oxides of nitrogen is achieved relative to the amount of nitrate removed, than if the potassium ions are removed along with the nitrate ions. Further greater reduction in HCN and CO delivery is observed.

2. Description of the Prior Art

Tobacco contains a number of nitrogen containing substances which during the burning of the tobacco yield various components in the smoke. Removal of some of these smoke components, such as the oxides of nitrogen, is considered desirable.

Nitrate salts, such as potassium, calcium and magnesium nitrates, are a major class of nitrogenous substances which are precursors for nitrogen oxides, especially nitric oxide. These nitrate salts are normally found in great abundance in burley tobacco stems and strip and to a lesser extent in fluecured tobacco stems and in reconstituted tobaccos which utilize these components. Attempts have been made to reduce or remove the nitrate from these tobaccos to bring about a significant reduction in the oxides of nitrogen delivered in their smoke. Among the techniques which have been employed to this end are extraction methods whereby the nitrates are removed from the tobacco material.

In accordance with extraction techniques, tobacco materials are generally contacted with water. In this manner, an extract containing the tobacco solubles including the nitrates, is formed. The extract is collected and may be discarded or may be treated to remove the nitrates. The denitrated extract may thereupon be reapplied to the fibrous insoluble tobacco material from which it was originally removed.

Although extract treatment methods seek to minimize the removal of materials other than nitrates from the tobacco and thereby avoid affecting the subjective characteristics of the tobacco or its filling capacity, burn qualities and the like, other materials are in fact removed by such methods. For example, the nitrates are commonly removed as potassium salts. Specifically, U.S. Pat. Nos. 4,131,118 and 4,131,117 describe a denitration process wherein potassium nitrate is crystallized from an aqueous tobacco extract followed by reapplication of the denitrated extract to the tobacco. In U.S. Pat. No. 3,847,164 denitration is effected by means of ion-retardation resins which retard ionic material, specifically potassium nitrate, in tobacco extracts, while non-ionic constituents pass unaffected. Thus, these methods remove not only nitrate ions, but also potassium ions.

In addition to denitration, extraction processes are employed where removal of other tobacco components is desired. For example, U.S. Pat. No. 3,616,801 describes a process for improving the tobacco burn properties, smoke flavor and ash by controlling the ion content of the tobacco. In accordance with the process therein disclosed the proportion of metallic ions in an aqueous tobacco extract is adjusted, followed by reapplication of the treated extract to the tobacco. Among the treatments suggested for adjusting the metal ion content are ion exchange and membrane electrodialysis. Removal of potassium ions and their replacement with ammonium, hydrogen, calcium or magnesium ions are particularly desirable in the practice of this process. Levels of other ions including nitrate may also be adjusted to alter the tobacco properties. In Example 6, over 50% of both nitrate and potassium ions were removed by means of electrodialysis.

It is apparent that prior art tobacco extract treatments typically remove potassium ions, as well as nitrate or other ionic materials. It has now been discovered, however, that if nitrate is removed from the tobacco extract while maintaining the potassium ion level substantially intact, a proportionately greater reduction in delivery of nitrogen oxides in tobacco smoke relative to degree of nitrate removal is achieved than when the potassium ions are also removed.

SUMMARY OF THE INVENTION

The present invention provides a method for treating tobacco whereby a reduction of various gas phase components of tobacco smoke is achieved. Specifically, reduced NO, HCN and CO deliveries by tobacco smoke are effected. Moreover, the relative reduction of nitrogen oxide delivery by tobacco products during combustion is maximized.

In accordance with the present invention, tobacco materials are contacted with an aqueous solution to obtain an aqueous extract and an insoluble fibrous tobacco portion. The extract and the insoluble fibrous materials are separated whereupon the extract is treated by ion extraction methods to selectively extract the nitrate ions without substantially reducing the potassium ion content. The thus treated extract may then be applied to an insoluble fibrous tobacco portion. Smoking tobacco products containing tobacco which has been treated in this manner produce relatively less nitric oxide than products from which the same amount of nitrate has been removed, but in a manner which reduces potassium ion levels as well.

DETAILED DESCRIPTION OF THE INVENTION

Figure 1:
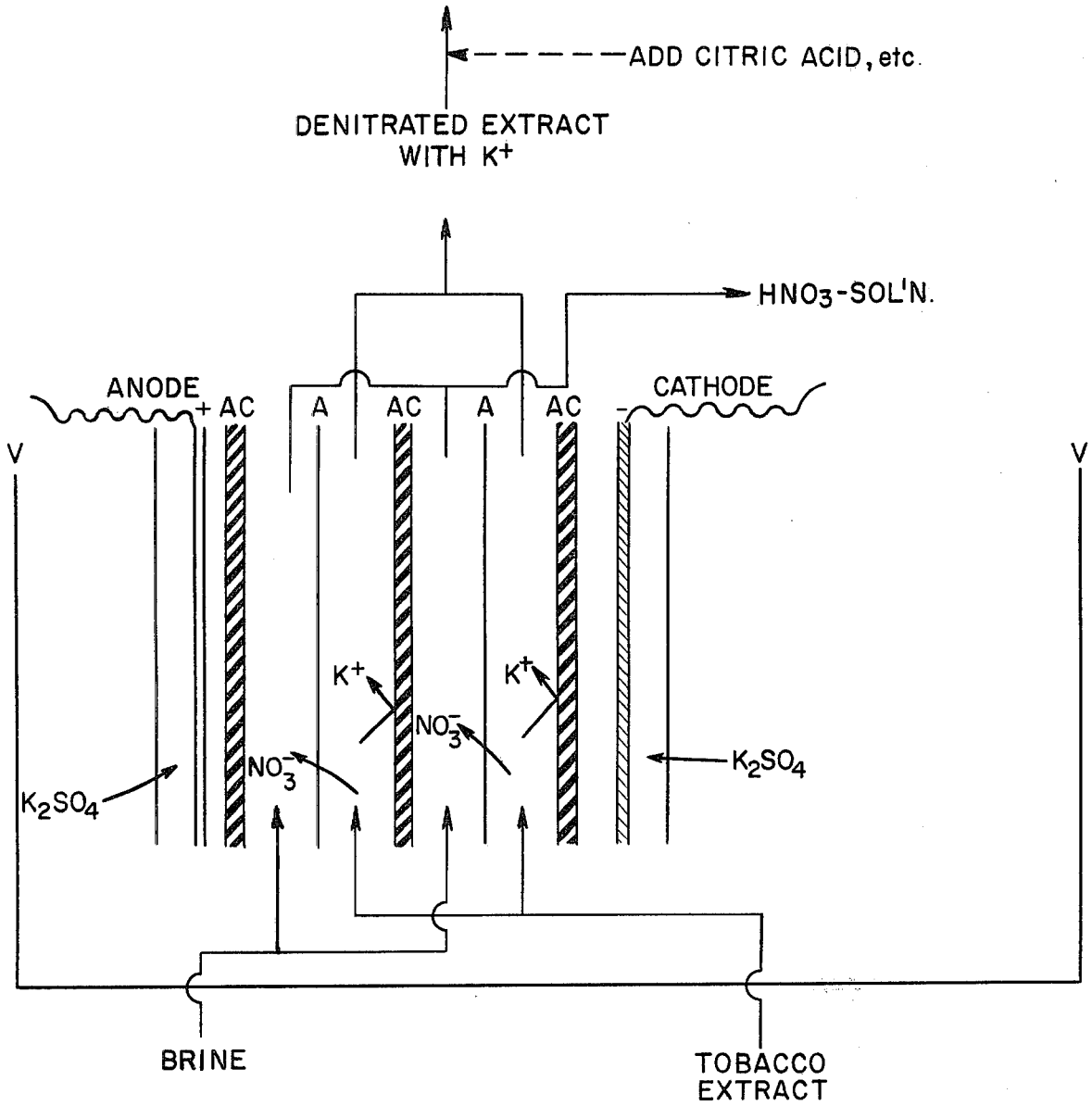
FIG. 1 is a schematic diagram of an electrodialysis stack which may be employed to practice the method of the invention.

In accordance with the present invention tobacco is denitrated in a manner which enhances the relative reduction in delivery of oxides of nitrogen and reduces the delivery of HCN and CO. This is accomplished by removal of nitrate ions, without concomitant removal of potassium ions present in the tobacco material, employing ion extraction techniques. By avoiding removal of the potassium ions a greater reduction in nitrogen oxide delivery, particularly nitric oxide, is achieved relative to the amount of nitrate removed, than is achieved with denitration techniques which reduce not only the levels of nitrate ions, but also potassium ion levels.

In the practice of the process, the tobacco material is typically contacted with an aqueous solution at 20°–100° C., preferably 60°–95° C., for a period of time ranging from a few seconds to several minutes depending on the particular temperature and volume of water or solubles used. In order to maximize the extraction of nitrate, the wetted tobacco is generally pressed or centrifuged at the end of the extraction time whereby the excess water and residual nitrate that may be present on the tobacco surface and in suspension are removed. By employing this mode of operation the need for excessive drying of the tobacco to remove the excess moisture can be avoided.

The resulting aqueous tobacco extract is separated from the insoluble fibrous tobacco residue. The extract and the insoluble material may be separated by conventional solid-liquid separation techniques. For example, pressing, centrifugation or filtration techniques may be employed.

The separated extract is treated such that the major precursors of oxides of nitrogen in smoke are removed while maintaining the potassium ion level substantially intact. As used herein, selective denitration refers to removal of such nitrogen oxide precursors without substantial potassium removal. Specifically the nitrate ions are the principal nitrogen containing components removed according to the present invention. During combustion these ions are believed to be the major source of oxides of nitrogen, particularly nitric oxide.

Extraction of nitrate ions from tobacco without substantially reducing the potassium ion level results in a proportionately greater reduction in delivery of oxides of nitrogen during combustion relative to nitrate removal, than is generally effected where potassium ions are removed during the denitration step. Further, the reduction in delivery of CO and HCN in smoke which has been selectively denitrated is greater than that effected with nonselective denitration methods. For purposes of the present invention references to reduction in gas phase components are intended to mean reduction in CO, NO and HCN.

In order to effect reduction of gas phase components of tobacco smoke in accordance with the present invention, ionic extraction techniques which permit selective removal of nitrate ions without substantially altering the potassium levels in the extract are employed to denitrate the tobacco. Such methods include membrane electrodialysis, ion exchange and Donnan dialysis.

Membrane electrodialysis is a preferred method for selective removal of the nitrate ions from the tobacco extract. By selection of the appropriate sequence of membranes, the nitrate levels can be reduced while the potassium levels remain substantially intact.

In a membrane electrodialysis set-up, the membranes are arranged in stacks which are disposed between an anode and a cathode. The stacks comprise anion permeable or neutral membranes alternating with impermeable bipolar membranes and are separated by appropriate spacers to form alternate brine and extract cells. The spacers are specially designed and manifolded to provide uniform flow distribution of tobacco extract passing between the membranes which alternately concentrate and dilute the ionic species ($NO_3^-$) in the tobacco extract in contact with them.

The tobacco extract flows through those alternate cells which have an anion permeable or neutral membrane toward the anode and an impermeable bipolar membrane toward the cathode while the extracting medium or brine flows through the remaining cells. These brine cells are thus confined between an impermeable membrane toward the anode and an anion permeable or neutral membrane toward the cathode.

The anions present in the tobacco extract cells, specifically the nitrate ions, migrate toward the anode upon imposition of an electrical potential. Thus nitrate ions in the tobacco extract migrate into adjacent brine cells where they remain, are concentrated and can be removed from the system. On the other hand, the potassium ions are retained in the tobacco extract by the impermeable bipolar type membrane when a potential is applied.

The electrodes employed in the electrodialysis unit may be carbon, stainless steel, platinum, or other type of non-corrosive conductive material that does not react with the electrolyte and does not introduce metallic ions in solution, especially polyvalent ions such as $Cu^{++}$ and $Al^{+++}$, that may react with the ionic membrane or with the tobacco solubles and cause membrane fouling and/or scaling on the membrane surface. Preferably hastelloy carbon cathode plates and platinized columbium anode plates are employed.

The solutions in the electrode cells may be different for the anode and the cathode, but preferably are the same. These electrolyte solutions should comprise an approximately 0.1 N solution of an alkali metal salt, preferably a potassium salt of an anion that will not react and will create minimum gas at the electrodes or of an anion that will not foul the membranes nor precipitate polyvalent cations such as Ca, Mg, Al, etc. at the surface of the membranes, especially at the particular pH that is being used. Salts that are particularly preferred are potassium acetate and sulfate at a pH of about 2–5. The purpose of the electrolyte solution is threefold, namely to increase and maintain the conductivity of the solution, to cool the electrodes and make them more efficient conductors, and to remove the hydrogen bubbles that accumulate on the electrode surfaces. The electrolyte is continuously recirculated to an electrolyte container which is vented to allow hydrogen to escape thereby preventing it from being recirculated to the electrodes. To assist in preventing the recirculation of dissolved hydrogen or the accumulation of gas (hydrogen) bubbles on the electrodes a non-ionic wetting agent, such as glycerine, Triton X-100, or the like may be employed. In addition, circulation of the electrolyte at a rapid rate will facilitate removal of oxygen or hydrogen gas bubbles from the electrodes.

The membranes employed to isolate the electrodes may be bipolar or cation permeable membranes of the same nature and thickness as those used in the overall stack. However, these membranes are preferably thicker, more ionic and tighter (less porous). Also, the spacers that are placed between the electrodes and the anode-cathode membranes may be of the same thickness as those used in the overall stack, but preferably they should be thicker, i.e., about twice the thickness of the remaining spacers to allow a greater circulation ratio of electrolyte on the surfaces of the electrodes.

The brine solution will typically be aqueous. It is preferable that a small concentration of ionic material be present in the brine during the initial phase of operation in order to create some conductivity. Thus for example the brine may initially be seeded to 0.1 weight percent potassium or sodium nitrate, chlorides or acetate, or nitric, hydrochloric, or acetic acid or with potassium or sodium hydroxide. In general the initial seeding of the brine to about 0.1 weight percent should be made with ions that are water soluble and will not affect the membranes. The brine may be recirculated through the system until the extraction of nitrate ions thereby is no longer efficiently effected.

The anion permeable membranes may be neutral or ionic membranes having a positive fixed electrical charge. Positively charged membranes will attract and pass anions and repel cations and are thus anion permeable. Cation permeable membranes are negatively charged and will attract and pass cations and repel anions. Neutral membranes will allow either anions or cations to pass through when a voltage is applied across the ionic solution that is confined between such membranes.

Bipolar type membranes are cation and anion impermeable membranes which contain positively charged groups on one face and negatively charged groups on the other. When these membranes are placed such that the membrane surface which contains the negatively charged groups is toward the cathode and the positively charged surface is facing the anode, the anions which are attracted towards the anode are repelled by the negatively charged membrane surface and the cations which are attracted toward the cathode are repelled and neither ion is allowed to pass through. Bipolar type characteristics can be achieved with a single membrane or two membranes, one anionic and one cationic, could be placed directly against each other to simulate a bipolar membrane.

The number and dimensions of the cells will depend upon the desired treatment rates, the size of commercially available membranes, the viscosity of the aqueous tobacco solubles and the need to maintain an acceptable flow rate at a pumping pressure below the rupturing point of the membranes. Other factors that determine the number and dimension of cells are the operating voltage, the amount of nitrate in the aqueous tobacco solubles, the solubles temperature, the desired degree of denitration, the resistivity of the membranes and the distance or thickness of the cells, and the desired mode of operation, viz. continuous vs. batch. Generally for a given system (voltage, nitrate level, treatment rate) the thinner, the more ionic and the smaller the spacing between the cell membranes, the smaller the membrane area or the fewer the cells required. Distances in the order of $\leqq 0.04$ inches have been found to be greatly preferred. The same is true when the applied voltage and the solubles temperature increase, with the limiting factors on upper voltages and operating temperatures being the nature of the membranes and spacers. The temperature should be below the critical temperature for the membranes and spacers to avoid damage; the voltage should be such as to avoid electrolysis and minimize transference of other tobacco substances, ionic or non-ionic in nature.

Although the membranes are relatively impermeable to non-ionic species, some transfer of non-ionic species and water will occur. The amount of such transfer depends on the amount of current passed through the membrane, the size of the non-ionized molecule and the "tightness" of the membrane.

The concentration of the tobacco extract is generally limited by flow rate which depends on the presence of substances that increase the extract's viscosity on the one hand and efficient denitration which depends on the concentration of nitrate ions on the other. Concentrations should be kept low enough to avoid membrane deposits and to permit flow without excessive resistance. As a practical matter, viscosity is the upper limit for tobacco extract concentration. At the low end of the range, the power required relative to the degree of deionization becomes the limiting factor. It has been found that the preferred concentrations of tobacco extract range between 5–50% solids having a low resistivity of 8–50 ohm-cm, more preferably 10–30% solids and a resistivity of 10–30 ohm-cm.

In operation the current density in amps per square centimeter of membrane greatly depends on the ionic strength or resistivity of the tobacco extract, the membranes, the amount of voltage or potential that is being applied, the operating temperature of the stack, the cell thickness, and the resistivity imposed by a certain amount of deposit of tobacco solids on the membrane surfaces which again depends on viscosity and flow rates. Preferably, the amount of voltage applied should be between 0.5 and 2.0 volts per cell pair. The limiting factors for the desired voltage are the larger capital investment for cells required when the lower voltages are used and the greater transfer of non-ionic species across the membranes and the greater probability of membrane "fouling" when the higher voltage is applied. Other limiting factors are cell thickness (spacing between membranes), membrane tightness, resistance, ionic strength of the tobacco solubles and membranes and the operating temperature of the system.

In order to avoid fouling of the membranes by polyvalent cations, such as magnesium or calcium, the pH of the tobacco extract should be kept on the acid side with acids, such as acetic or hydrochloric. By this means water soluble magnesium and calcium salts are maintained in solution, thus preventing the cations from being converted into insoluble hydroxides, carbonates or the like which may deposit on the membrane surfaces and cause scaling. Thus, chemical fouling may be avoided in the treatment of aqueous tobacco extracts by maintaining the pH of the extract below 7.0, normally 5–5.6 with an acid such as acetic when using the bipolar membranes for the selective nitrate removal. Alternatively, polyvalent cations and anions and peptides may be precipitated and filtered from the extract prior to applying electrodialysis. A small membrane spacing and tighter membranes may also be used with application of sufficient current (0.5 to 2.0 volts/cell pair) to allow the most mobile ions, such as nitrate, to be extracted while the less mobile ions are flashed out of the cells by rapidly circulating the solubles, thereby avoiding their embedding in the membrane pores. Also, the more mobile ions will displace such ions as calcium, magnesium, citrate and the like even from the ionic membranes.

When very dilute streams are to be deionized and to reduce membrane fouling and energy requirements, that is, avoid electrolysis, a system using ion exchange resins and membrane electrodialysis can be used. This is called electroregenerated ion exchange deionization. The setup is similar to that of membrane electrodialysis but with the addition of a mixed bed of weak ion exchange or ionic resins between each pair of anion permeable and cation-impermeable membranes that form the cells through which the tobacco solubles are to be passed. The dilute solution of ions to be deionized enter the cells that contain the mixed bed of resins. The ions are "trapped" or picked up by the resins causing an increase in ionic concentration and electroconductivity between the electrodes of the electrodialysis cell and thus a lesser amount of electrical power is required. The applied electrical potential causes the anions to transfer through their respective membranes into the brine cells where they are concentrated and removed. The mixed bed of the weak ion exchange resins is continuously regenerated without interruption and without the use of high amounts of additional chemicals or additional power as is the case with standard ion exchangers. The mixed bed of weak ion exchange resins may be composed of a single resin having both negative and positive groups, two different resins, one anionic and one cationic, in bead or "spacer" type form. The spacer form may be in a basket or wire cloth type weave or in film form (similar to bipolar membranes) specially manifolded to allow flow.

FIG. 1 is a schematic representation of the operation of an electrodialysis stack which may be employed in the practice of the invention. The stack is disposed in vessel V. The potassium nitrate containing tobacco extract is fed into those cells of the stack which comprise an anion/cation impermeable bipolar membrane AC toward the cathode and an anion permeable membrane A toward the anode. The electrolyte employed is $K_2SO_4$. Brine is in turn circulated in the remaining cells. The nitrate ions migrate from the extract through the membranes A into the brine cells and are passed out of the system as a $HNO_3$ solution. The potassium ions present in the tobacco extract cannot pass through membranes AC and thus remain in the extract when it leaves the system. The exiting denitrated, potassium ion containing extract may thereupon be neutralized with an acid such as citric acid.

Another method of selectively removing the nitrate ions in accordance with the invention entails passing the tobacco extract in either dilute or concentrated form over an anion exchange resin. The resins which may be employed are those which will attract anions (i.e., cationic resins) or those which will readily exchange an anion with the nitrate ions of the tobacco extract. Primary, secondary and tertiary amine resins may be employed. More specifically anion exchange resins having the following formulas are generally suitable: $R_4N^+X^-$, RR'NH or $R_3N$, wherein each R is an alkyl and R' is alkyl or hydrogen and X— is an inorganic anion, such as chloride, sulphate or acetate or most preferably hydroxide. Typical anion-exchange resins that were used and found to be acceptable are the Rexyn 201 resins (Fisher Scientific trademark) which is equivalent to Dowex 1-X8 (Dow Chemical Company's trademark), Amberlite 1RA-400 (trademark of Rohm & Haas), Permutit S-1 (AG) (trademark of Pfaudler Permutit Company). They are generally of the polystyrene-divinylbenzene alkyl quaternary amine chemical type. In general other similar or somewhat weaker resins could also be used. Such weakly basic anion-exchange resins include the primary, secondary and tertiary amines having a high molecular weight. These are generally weaker insoluble commercially sold resins such as Amberlite 1R 4B and IR45, 1A-1 (trademarks of Rohm & Haas), Dowex 3 (trademark of Dow Chemical Company), Duolite A2, A4, A6, A7, A114, etc. These resins are very applicable for the selective denitration of tobacco extracts. The dilute tobacco extract having a solids concentration of about 3–30% is contacted with the weakly or strongly basic anion exchange resin either in a batch process in which the tobacco extract is added to the resin and then processed or on a continuous basis by passing the tobacco extract through a column or bed of anion-exchange resin.

Selective denitration may also be effected by means of Donnan dialysis. In employing this method a cationic membrane (positively charged, anion permeable) is utilized to separate the tobacco extract from the stripping solution. The stripping solution will be a preferably strong base, such as sodium or potassium hydroxide at a pH of 7.5 to 9.5. The time required to denitrate the tobacco extract depends on the membrane surface, the thickness of the membrane and the tobacco extract compartment as well as the nitrate concentration and temperature used. Materials such as metaphosphates may be added to the tobacco extract or stripping media to maintain polyvalent metal ions in solution and prevent their precipitation on the membrane surface.

Finally the selective nitrate removal may be accomplished by liquid extraction according to techniques such as those suggested in U.S. Pat. No. 3,983,222.

Following the selective denitration of the tobacco extract, the extract is recombined with the insoluble tobacco material from which it was removed. Prior to reapplication the extract may be concentrated if necessary or desired. The reapplication may be effected by any suitable means such as spraying, coating, dipping or slurry processes. The tobacco may then be dried or otherwise processed to put it in condition for use in tobacco products. Thereupon treated tobacco may be used in any smoking tobacco product desired. Any such smoking tobacco product will exhibit reduced delivery of nitrogen oxides, HCN and CO during combustion. Further, the ratio of nitrogen oxide reduction to nitrate removed for products formed from tobacco treated in accordance with the invention is greater than that for products containing tobacco which has not been selectively denitrated.

Where, following denitration, the potassium ions are in an alkaline form, such as potassium hydroxide, it is preferred to neutralize the extract prior to reapplication to the tobacco. Such neutralization may be effected by titrating the extract with an acid, such as phosphoric, acetic, citric, malic or the like. Alternatively, neutralization may be effected by bubbling carbon dioxide gas through the extract to form potassium carbonates and/or bicarbonates. Although this neutralization does not appear to alter the nitrogen oxides delivered by smoke, it does appear to enhance the subjective smoking characteristics of the tobacco product.

Also prior to reapplication it may be desirable or necessary to concentrate the denitrated extract. This may be accomplished by evaporation methods, such as thin film flash evaporation, reverse osmosis or ultramicrofiltration, as well as other conventional concentration techniques.

Following reapplication of the denitrated extract to the tobacco residue the resulting tobacco material may be shredded to form filler for a smoking tobacco product. The coarseness of the shredding affects the gas phase delivery of HCN, CO and NO. Coarser fillers result in relatively greater reduction in delivery of such gas phase components than do less coarse fillers. Thus fillers shredded at about 15 cuts/inch result in greater gas phase reduction than fillers cut at 30 cuts/inch.

In order to minimize loss of solubles other than nitrate, extraction of the tobacco material may be effected with denitrated tobacco extracts. By means of this expedient it is possible to reduce the amount of non-nitrate materials removed since after several extractions the extract liquor will approach saturation. Thus, except for the nitrates, reduced amounts of materials will be removed during subsequent extraction steps. This is a preferred mode of operation for treating tobacco strip or tobacco to be reconstituted.

It is to be understood that the process of the invention may be employed with whole cured tobacco leaf, cut or chopped tobacco, tobacco filler, reconstituted tobacco, tobacco stems and the like. As used herein, references to tobacco and tobacco materials are to be understood to include all such forms of tobacco. Further it is to be understood that the tobacco treated in accordance with the invention reduces nitrogen oxide delivery in any tobacco product which is consumed by combustion and that references to smoking tobacco products include cigars, cigarettes, cigarillos and the like.

The following examples are illustrative:

EXAMPLE 1

Five liters of tobacco solubles containing 19.3% tobacco solids and 0.418% $NO_3^-$-N were denitrated via electrodialysis in the following manner:

The electrodialysis unit was set up using alternating anion permeable and bipolar membranes to form 15 tobacco extract and brine cell pairs in an alternating pattern. The unit also contained an electrolyte cell at each pole. The electrolyte consisted of 0.1 N $K_2SO_4$ at a pH of 2–4 (adjusted with $H_2SO_4$) and contained a small amount of Triton X-100 (non-ionic wetting agent). The bipolar membranes used in the setup were formed by facing one surface of an anion permeable membrane directly in contact with one of the surfaces of a cation permeable membrane resulting in a single bipolar membrane having a positive charge on the surface facing the anode and a negative charge on the surface facing the cathode.

The unit was 9"×10" with an effective membrane area of 3.75 square feet. The membranes used were Ionics' 103 QZL anion and 61 CZL cation permeable membranes. These membranes were separated by polypropylene spacers 0.04" thick. The membranes in front of the electrodes were Ionics' 61AZL-389 membranes with 0.08" thick polypropylene spacers. A platinum-niobium anode and a stainless cathode were employed.

The tobacco solubles passed through the alternating cells that were located on the cathode side of the individual anion permeable membranes. Although the initial pH of the tobacco solubles were approximately 5, during the run the pH tended to become more neutral to basic. Therefore, to maintain the pH between about 5–6 approximately 71.4 grams of glacial acetic acid was used during the run.

The brine cells were placed in an alternating pattern on the anode side of the individual anion permeable membranes. The brine solution was 0.1% $KNO_3$ having an initial pH of 6.

The temperature of the various solutions (tobacco solubles, brine, and electrolyte) was maintained between 90°–96° F. during the run. The flow rate at 23 psi pumping pressure was set at 1600 cc/minute. When an electrical potential of 2 volts/cell pair was applied, the nitrate ions (and chloride ions) were transported from the tobacco solubles towards the anode. The nitrate and chloride ions passed through the anion permeable membranes into the brine cells where they were retained and concentrated. During the run, the pH of the brine solution decreased from 6 to 1.

TABLE 1

| Time (in minutes) | % $NO_3^-$—N | % Reduction | % $K^+$ | % $Ca^{++}$ | % $Mg^{++}$ |
|---|---|---|---|---|---|
| 0 (control) | 0.418 | — | 9.4 | 2.6 | 1.0 |
| 100 | 0.354 | 15.3 | — | — | — |
| 223 | 0.286 | 31.6 | — | — | — |
| 485 | 0.123 | 70.6 | — | — | — |
| 635 | 0.056 | 86.6 | — | — | — |
| 675 | 0.038 | 90.9 | 9.0 | 2.6 | 1.0 |

EXAMPLE 2

Burley tobacco was extracted with water and portions of the extract were subjected to ion exchange treatments. One portion was treated with a Fisher Scientific Rexyn 201 (OH) anion exchange resin, which is a polystyrene-divinyl benzene alkyl quaternary amine having $R_4N^+$ active groups, to selectively remove nitrate ions without removing potassium ions. A second portion of the tobacco solubles was treated with a mixed bed of exchange resins composed of the above Fisher Scientific Rexyn 201 resin and a Fisher Scientific Rexyn 101 (H) cation exchange, which is a sulfonated polystyrene-divinyl benzene copolymer having $RSO_3^-$ active groups, to effect removal of both potassium and nitrate ions. The composition of the extract and the gas phase delivery of the tobacco upon recombination with the extracts were analyzed. Similar analyses were conducted on unextracted burley tobacco, burley tobacco extracted with water and burley tobacco extracted with water and cased with potassium citrate.

Corresponding analyses were performed on a tobacco blend composed of burley, bright, Oriental and reconstituted tobaccos wherein the burley and reconstituted tobacco portions were subjected to the various extraction and/or casing treatments.

The results are set forth in Table 2.

TABLE 2

| | | | | Gas Phase in Cigarette Smoke by GC mg/puff | | | |
|---|---|---|---|---|---|---|---|
| Type | Cigarette Filler Treatment | $NO_3$—N % | K % | NO $\times 10^{-2}$ | HCN $\times 10^{-2}$ | CO | P.C. Puffs/Cigt. |
| Burley | — | 0.44 | 4.10 | 5.4 | 1.6 | 1.9 | 9 |
| " | Extracted with $H_2O$ | 0.21 | 2.32 | 3.9 | 1.3 | 1.9 | 10 |
| " | Extracted + $K_3$-Citrate | 0.20 | 3.35 | 2.8 | 0.8 | 1.7 | 10 |
| " | Anion-Exchanged | 0.20 | 3.96 | 2.3 | 0.4 | 1.2 | 10 |
| " | Anion/Cation-Exchanged | 0.20 | 2.65 | 2.9 | 0.9 | 1.5 | 11 |
| Blend | — | 0.23 | 3.67 | 3.1 | 2.0 | 1.9 | 8 |
| " | Extracted with $H_2O$ | 0.06 | 1.83 | 1.7 | 2.44 | 2.0 | 9 |
| " | Anion/Cation-Exchanged | 0.06 | 1.85 | 1.4 | 2.4 | 1.8 | 11 |
| " | Anion-Exchanged | 0.07 | 3.69 | 1.2 | 1.2 | 1.6 | 9 |
| " | Cation-Exchanged | 0.22 | 3.09 | 2.9 | 3.0 | 2.2 | 9 |

EXAMPLE 3

A well blended batch of burley tobacco was extracted with hot (90° C.) water using a tobacco/water ratio of 1:25. The wet tobacco was then filtered and pressed under vacuum of 26 psi. The insoluble tobacco residue was allowed to dry at room conditions. The aqueous extract containing the tobacco solubles was concentrated to 15.5% solids and split into two equal portions.

The first portion was then selectively dialyzed employing the conditions and electrodialysis setup of Example 1.

TABLE 3

| Electrodialysis Technique | None (Control Original Extract | Selective $NO_3^-$ Removal | | Non-Selective $NO_3^-$ Removal | |
|---|---|---|---|---|---|
| % DWB | | Denitrated Extract | % Removed | Denitrated Extract | % Removed |
| $NO_3$—N | 1.25 | 0.23 | 81.6 | <0.04 | >96.8 |
| Total-N | 6.2 | 5.8 | 6.5 | 5.5 | 11.3 |
| $Cl^-$ | 1.74 | 0.62 | 64.4 | <0.1 | >99.4 |
| $K^+$ | 10.0 | 9.7 | 3.0 | 5.84 | 41.6 |
| $Ca^{++}$ | 2.8 | 2.8 | 0.0 | 3.2 | — |
| $Mg^{++}$ | 1.07 | 1.07 | 0.0 | 1.06 | 0.9 |

TABLE 4

| Treatment | Tob. Composition | | | Gas Phase Analysis by GC | | | | Redns. in Smoke %/puff | | |
|---|---|---|---|---|---|---|---|---|---|---|
| | $NO_3$-N % | K % | $NO_3$-Redn. % | NO μg/puff | HCN μg/puff | CO mg/puff | P.C. puffs/cigt | NO | HCN | CO |
| None (Burley Control) | 0.50 | 4.45 | — | 51.0 | 13 | 1.23 | 11 | — | — | — |
| Selectively Denitrated Burley by Electrodialysis | 0.16 | 5.77 | 68 | 17.2 | 6.2 | 1.17 | 14.5 | 66.3 | 52.3 | 4.9 |
| Non-Selectively Denitrated Burley by Electrodialysis | 0.04 | 4.25 | 92 | 10.3 | 4.3 | 0.81 | 18.5 | 79.8 | 66.9 | 34.1 |

The second portion was non-selectively electrodialyzed employing a 20 cell pair membrane electrodialysis unit. The membranes were 9"×10" with an effective membrane area of 5 ft.$^2$ The cells comprised Ionics' 61CZL386 cation permeable paired with 103QZL 386 anion permeable membranes. These anion permeable membranes are about 0.63 mm thick, contain about 36 weight percent water and comprise crosslinked copolymers of vinyl monomers and contain quarternary ammonium anion exchange groups and are homogeneously film cast in sheet form on a reinforcing synthetic fabric composed of modacrylic polymer. The cation permeable membranes are about 0.6 mm thick, contain about 40 weight percent water and comprise crosslinked sulfonated copolymers of vinyl compounds which are also homogeneously film cast in sheet form on synthetic reinforcing fabrics. The spacers were 0.04". The membranes in front of the electrodes were Ionics' 61AZL-389 which were separated from the platinum-niobium, stainless steel electrodes by 0.08" thick spacers. The brine solutions were 0.1% aqueous $KNO_3$ solutions, and the electrolytes were 0.1 N $K_2SO_4$ and $H_2SO_4$ having a pH adjusted to 2 to 4. The electrodialysis was effected with application of 30 volts.

A partial analysis of the electrodialyzed solubles was done. The results thereof are set forth in Table 3.

The electrodialyzed solubles from each portion of tobacco extract were then reapplied by spraying on equal portions of the dry insoluble residue. The sprayed tobacco was then shredded into cigarette filler to produce cigarettes of the same construction and weight.

Control cigarettes of the same construction and weight as the denitrated cigarettes were formed from untreated tobacco from the same blended batch of burley employed in the extraction of the denitrated cigarettes.

The results of the analyses of these cigarettes are set forth in Table 4.

The data in Table 4 indicates that the denitration of tobacco by electrodialysis reduces such smoke components as NO, HCN and CO. The reductions in NO are practically linear relative to nitrate reduction when the denitration is selective and lesser relative to % $NO_3$ removed when the denitration is nonselective.

EXAMPLE 4

The results obtained with the cigarettes tested in Example 3 were compared with cigarettes formed from tobacco which had been treated in exactly the same manner, except that the tobacco was more coarsely cut. The results of the analyses of cigarettes containing the coarser filler (15 cuts/inch) and the Table 4 results of the analyses of the cigarettes of Example 3 (30 cuts/inch) are compared in Table 5.

TABLE 5

| Tobacco Treatment | Reduction in Cigt. Smoke Components %/puff NO | HCN | CO |
|---|---|---|---|
| 1. Burley control cut at 30 cuts/inch | | | |
| 2. Burley control cut at 15 cuts/inch | 12.2 | 26.2 | 28.5 |
| 3. Selectively denitrated burley by electrodialysis cut at 30 cuts/inch | 66.3 | 52.3 | 4.9 |
| 4. Selectively denitrated burley by electrodialysis cut at 15 cuts/inch | 69.0 | 72.3 | 35.8 |
| 5. Non-selectively denitrated burley by electrodialysis cut at 30 cuts/inch | 79.8 | 66.9 | 34.1 |
| 6. Non-selectively denitrated burley by electrodialysis cut at 15 cuts/inch | 81.4 | 67.7 | 44.7 |

The results indicate that the denitration of burley tobacco by electrodialysis (selective, Samples 3 and 4 or nonselective Samples 5 and 6) reduces such gas phase components from cigarette smoke as NO, HCN and CO. However, when the mode of denitration is selectively carried out for nitrate (only nitrate is primarily removed and no potassium), the % reduction of NO in cigarette smoke is practically linear relative to the % denitration of the filler. In the case of nonselective denitration, the % NO reduction is lower than the degree of denitration. Much greater reductions are achieved in such gas phase smoke components as NO, HCN and CO when denitration is combined with a coarsely cut cigarette filler.

EXAMPLE 5

Water extracted solubles from Burley tobacco were selectively denitrated by passage through an anion exchange resin of the general formula $R_4N+OH-$ (Fisher Scientific Company's Catalog No. R-205, Rexyn 201 (OH)) to tie up the anions, especially the nitrate ions ($NO_3-$) as $R_4N+NO_3-$ and exchange them with hydroxyl. As a result, the nitrate content in the solubles was practically removed in its entirety and the pH of the treated solubles was increased from 5.8 to 13.5.

The exchanged solubles were concentrated to about 20–25% solids with the use of a thin film evaporator at 40° C. and were then split into two aliquots, A and B. Aliquot A was returned by spraying to its original level on the extracted tobacco, and Aliquot B was similarly returned to the extracted tobacco after its original pH (5.8) was restored by addition of citric acid.

These tobaccos were then used to make cigarettes and obtain analytical (Tables 6 and 7) and subjective (Tables 8 to 10) data. The experimental data indicated that both experimental cigarettes delivered lower NO values in smoke when compared to a control cigarette. Subjectively, both experimental samples compared favorably to the control. However, when the experimental samples were compared to each other the preferred sample cigarette was the one which contained the denitrated solubles at their original pH.

TABLE 6

ANALYTICAL DATA OF BLENDED CIGARETTES WITH EXCHANGED IONS

| | Filler | | | Smoking Results | | | | | | |
|---|---|---|---|---|---|---|---|---|---|---|
| | % $NO_3$— | % K | % $NO_3$—N Reduction | pH | FTC Tar mg/cigt | CO mg/cigt | HCN mg/cigt | NO mg/cigt | P.C. puffs/cigt | % NO Reduction |
| Blend Control | 0.26 | 3.96 | — | 5.7 | 17.6 | 16 | 0.20 | 0.28 | 9 | — |
| Blend w/Anion Exchanged Burley Solubles w/o pH Adjustment | 0.18 | 3.93 | 31 | 6.4 | 17.0 | 18 | 0.19 | 0.22 | 9 | 21 |
| Blend w/Anion Exchanged Burley Solubles w/pH Adjustment (Citric Acid) | 0.18 | 3.82 | 31 | 5.8 | 17.2 | 18 | 0.17 | 0.21 | 10 | 25 |

TABLE 7

PUFF BY PUFF
TAR AND NICOTINE DELIVERY OF BLENDED CIGARETTES CONTAINING BURLEY WITH EXCHANGED IONS

| Treatment of | Control | | Anion Exchanged w/o pH Adjustment | | Anion Exchanged w/pH Adjustment (Citric Acid) | |
|---|---|---|---|---|---|---|
| Burley Strip Puff Number | TPM mg | Nicotine mg | TPM mg | Nicotine mg | TPM mg | Nicotine mg |
| 1 | 1.04 | 0.06 | 1.55 | 0.08 | 1.61 | 0.09 |
| 2 | 1.30 | 0.12 | 2.02 | 0.11 | 2.00 | 0.12 |
| 3 | 1.40 | 0.13 | 2.28 | 0.14 | 2.17 | 0.13 |
| 4 | 2.18 | 0.14 | 2.48 | 0.15 | 2.54 | 0.16 |
| 5 | 2.39 | 0.16 | 2.54 | 0.15 | 2.42 | 0.16 |
| 6 | 2.39 | 0.16 | 2.70 | 0.16 | 2.78 | 0.17 |
| 7 | 2.55 | 0.17 | 2.96 | 0.16 | 2.91 | 0.18 |
| 8 | 3.85 | 0.17 | 3.00 | 0.14 | 3.82 | 0.19 |

TABLE 8

SUBJECTIVE DATA

| | RESULTS | | |
|---|---|---|---|
| | Control | Experimental[1] | No Difference |
| Harsher | 12 | 16 | 6 |
| More Total Taste | 15 | 8 | 9 |
| Off Taste | 7 | 7 | 19 |
| Spicy | 10 | 14 | 9 |
| Sweeter | 10 | 9 | 16 |
| More Bitter | 7 | 13 | 16 |
| More Tobacco-Like | 16 | 9 | 10 |
| Hotter | 7 | 15 | 13 |
| Prefer | 17 | 9 | 9 |
| Overall Acceptability | 4.51 | 4.05 | |
| Probability | NS | | |

[1]Blend Substituting Denitrated Burley Cased with Anion Exchanged Burley Solubles for Burley

TABLE 9

SUBJECTIVE DATA

| | RESULTS | | |
|---|---|---|---|
| | Control | Experimental[1] | No Difference |
| Harsher | 16 | 20 | 10 |
| More Total taste | 21 | 13 | 12 |
| Off Taste | 11 | 13 | 22 |
| Spicy | 15 | 24 | 7 |
| Sweeter | 19 | 8 | 19 |
| More Bitter | 13 | 21 | 12 |
| More Tobacco-Like | 20 | 12 | 14 |
| Hotter | 13 | 20 | 13 |
| Prefer | 21 | 16 | 9 |
| Overall Acceptability | 3.67 | 3.61 | |
| Probability | NS | | |

[1]Blend Substituting Denitrated Burley Cased with Anion Exchanged Burley Solubles containing Citric Acid for Burley

TABLE 10

| SUBJECTIVE DATA | RESULTS | | |
|---|---|---|---|
| | Control[1] | Experimental[2] | No Difference |
| Harsher | 21 | 7 | 11 |
| More Total Taste | 12 | 13 | 14 |
| Off Taste | 15 | 5 | 19 |
| Spicy | 19 | 7 | 13 |
| Sweeter | 4 | 15 | 20 |
| More Bitter | 20 | 4 | 15 |
| More Tobacco-Like | 8 | 14 | 16 |
| Hotter | 17 | 7 | 15 |
| Prefer | 8 | 18 | 13 |
| Overall Acceptability | 3.59 | 4.08 | |
| Probability | 0.07 | | |

[1]Blend Substituting Denitrated Burley Cased with Anion Exchanged Burley Solubles for Burley
[2]Blend Substituting Denitrated Burley Cased with Anion Exchanged Burley Solubles Containing Citric Acid for Burley

What is claimed is:

1. A method of treating tobacco to reduce its delivery of gas phase components during combustion which comprises:

(a) contacting a tobacco material with an aqueous solution to obtain an aqueous potassium nitrate containing extract and an insoluble tobacco residue;

(b) separating the aqueous extract from the insoluble tobacco residue;

(c) selectively removing the nitrate ions from the tobacco extract without substantially reducing the potassium ion level employing an ionic extraction technique; and (d) combining the denitrated aqueous extract with insoluble tobacco residue which has been treated in accordance with steps (a) and (b).

2. The method of claim 1 wherein the selective removal of nitrate ions is effected by means of membrane electrodialysis.

3. The method of claim 2 wherein the electrodialysis unit comprises alternating bipolar and anion permeable membranes.

4. The method of claim 1 wherein the selective removal of nitrate ions is carried out by means of electroregenerating ion exchange deionization.

5. The method of claim 1 wherein the selective removal of nitrate ions is carried out by means of anion exchange resins.

6. The method of claim 1 wherein the selective removal of nitrate ions is carried out by means of Donnan dialysis.

7. The method of claim 1 wherein the aqueous solution employed in step (a) comprises a denitrated aqueous tobacco extract containing tobacco solubles.

8. The method of claim 1 which further comprises neutralizing the metallic ions in the denitrated extract with acid prior to recombining with the tobacco residue.

9. A method of treating tobacco to reduce its delivery of oxides of nitrogen during combustion which comprises:

(a) contacting a tobacco material with an aqueous solution to obtain an aqueous potassium nitrate containing extract and an insoluble tobacco residue;

(b) separating the aqueous extract from the insoluble tobacco residue;

(c) selectively removing the nitrate ions from the tobacco extract without substantially reducing the potassium ion level employing an ionic extraction technique; and (d) combining the denitrated aqueous extract with insoluble tobacco residue which has been treated in accordance with steps (a) and (b).

10. The method of claim 9 wherein the selective removal of nitrate ions is effected by means of membrane electrodialysis.

11. The method of claim 9 wherein the selective removal of nitrate ions is carried out by means of anion exchange resins.

12. The method of claim 9 wherein the aqueous solution employed in step (a) comprises a denitrated aqueous tobacco extract containing tobacco solubles.

13. The method of claim 9 which further comprises neutralizing the metallic ions in the denitrated extract with acid prior to recombining with the tobacco residue.

14. A method of making a smoking tobacco product which exhibits reduced delivery of gas phase components during combustion which comprises subjecting tobacco to the following treatments:

(a) contacting a tobacco material with an aqueous solution to obtain an aqueous potassium nitrate containing extract and an insoluble tobacco residue;

(b) separating the aqueous extract from the insoluble tobacco residue;

(c) selectively extracting the nitrate ions from the tobacco extract without substantially reducing the potassium ion level by means of an ion extraction technique;

(d) recombining the denitrated aqueous extract with the insoluble tobacco residue;

and thereafter incorporating the tobacco into a smoking product.

15. The method of claim 14 wherein the tobacco material resulting from step (d) is coarsely shredded before incorporation into a smoking product, whereby further reduction of gas phase components is effected.

16. The method of claim 15 wherein the material is shredded down to about 15 cuts/inch.

17. A method for selectively denitrating tobacco which comprises:

(a) contacting a tobacco material with an aqueous solution to obtain an an aqueous potassium nitrate containing extract and an insoluble tobacco residue;

(b) separating the aqueous extract from the insoluble tobacco residue;

(c) selectively removing the nitrate ions from the tobacco extract without substantially reducing the potassium ion level employing an ionic extraction technique; and (d) combining the denitrated aqueous extract with insoluble tobacco residue which has been treated in accordance with steps (a) and (b).

* * * * *